US005413221A

United States Patent [19]

Mizuno

[11] Patent Number: 5,413,221

[45] Date of Patent: May 9, 1995

[54] PACKAGING FOR A PHOTOGRAPHIC FILM CASSETTE

[75] Inventor: Kazunori Mizuno, Kanagawa, Japan

[73] Assignee: Fuji Photo Film Co., Ltd., Kanagawa, Japan

[21] Appl. No.: 161,450

[22] Filed: Dec. 6, 1993

Related U.S. Application Data

[63] Continuation of Ser. No. 883,573, May 15, 1992, abandoned.

[30] Foreign Application Priority Data

May 17, 1991 [JP] Japan ..... 3-141298

[51] Int. Cl.[6] ..... B65D 85/67

[52] U.S. Cl. ..... 206/397; 206/408; 206/416; 206/594

[58] Field of Search ..... 206/396, 397, 408, 415, 206/416, 522, 591, 594, 409; 242/71.1

[56] References Cited

U.S. PATENT DOCUMENTS

| | | | |
|---|---|---|---|
| 3,142,599 | 7/1964 | Chavannes | 206/522 |
| 3,669,255 | 6/1972 | Raymus | 206/397 |
| 3,944,148 | 3/1976 | Freeman et al. | 242/71.1 |
| 4,239,164 | 12/1980 | Barnsbee et al. | 242/71.1 |
| 4,339,039 | 7/1982 | Mykleby | 206/594 |
| 4,398,814 | 8/1983 | Muylle et al. | 242/71.1 |
| 4,756,418 | 7/1988 | Johanson et al. | 206/408 |
| 4,773,534 | 9/1988 | Deheras et al. | 206/591 |
| 4,826,008 | 5/1989 | Cloosterman | 206/415 |
| 4,834,306 | 5/1989 | Robertson et al. . | |
| 4,846,418 | 7/1989 | Fairman . | |
| 5,053,811 | 10/1991 | Watabe et al. | 206/397 |

FOREIGN PATENT DOCUMENTS

| | | | |
|---|---|---|---|
| 2415595 | 12/1980 | France | 206/409 |
| 63-165650 | 10/1988 | Japan . | |
| 848248 | 9/1960 | United Kingdom | 206/522 |

*Primary Examiner*—David T. Fidei

*Attorney, Agent, or Firm*—Sughrue, Mion, Zinn, Macpeak & Seas

[57] ABSTRACT

A packaging for a photographic film cassette in which rotation of a spool causes a leader of a photographic film to advance outward through a passage mouth of a cassette shell. The packaging has a carton which contains the cassette shell. An air cell of a bubbled sheet holds one spool end on to the inside of the carton, and stops the spool from rotating while the cassette is contained in the carton. In a preferred embodiment, a port stopper is fitted to the port portions to close the passage mouth, and packaged in a shrink wrap. In another preferred embodiment, the cassette is packaged in a shrink wrap in a state where a spool stopper is engaged with the spool.

3 Claims, 7 Drawing Sheets

PACKAGING FOR A PHOTOGRAPHIC FILM CASSETTE

This is a Continuation of application Ser. No. 07/883,573, filed May 15, 1992 now abandoned.

BACKGROUND OF THE INVENTION

1. Field of the Invention

The present invention relates to a packaging for a photographic film cassette, more particularly to a packaging suitable for packaging a cassette of which rotation of a spool causes a leader to advance outward from the cassette.

2. Description Related to the Prior Art

A conventional photographic film cassette (hereinafter referred to as a cassette) has a metal cassette shell, which rotatably contains a plastic spool around which a photographic filmstrip (hereinafter referred to as film) is wound. The cassette shell is constituted of a cylinder made of a metal sheet and caps fitted on its both ends of the cylinder. A leader of the photographic film protrudes from the cassette even before the photographic film is used. This cassette is packaged in a cap-fitted cylindrical, moisture-proof plastic case called a P case, and overwrapped in a carton for retail sale.

Also, it is known to utilize a photographic film cassette wherein the photographic film is positioned so that the leader does not protrude from a cassette shell prior to loading the cassette in a camera. Such a cassette is described in U.S. Pat. Nos. 4,834,306 and 4,846,418. Simple film-advancing mechanisms of the camera are used with this type of cassette, and include a construction which rotates a spool to unwind the photographic film, thereby causing the leader to move through a passageway for the photographic film and thereby exit from the cassette. This cassette is advantageous over the other conventional cassette discussed above, because the photographic film can be shielded from light more reliably, and the cassette can be loaded in the camera with greater ease.

The conventional packaging constituted of the P case and the carton, however, is disadvantageous. In particular, its double structure is costly and requires the troublesome operation of double removal, i.e., removal of the P case from the carton, and removal of the cassette from the P case. When using a P case for the above-described leader-advancing cassette, the leader may be inadvertently advanced outward from the cassette due to shock or vibration during mass transportation or while being carried by the user. The cassette under such a condition cannot be loaded in a camera if the camera is adapted for use only with a leader-advancing cassette which is loaded in a state without protrusion of the leader. In a leader-advancing cassette, smooth leader advancement requires that the turns of the photographic film are wound regularly around a spool before advancement. Rotation of the spool due to the shock or vibration, however, causes the film turns to be irregular within the cassette shell. Accordingly, the leader might not reliably exit from the cassette.

Japanese Utility Model Laid-open Publication No. 63-165650 proposes an attachment of a seal to a spool which partially projects from the cassette shell, so that the spool cannot rotate relative to a cassette shell before the photographic film is exposed. However, this structure is difficult to apply to a leader-advancing cassette, because such a cassette generally has a structure such that ends of a spool do not project from, but are flush with, or retracted from, the shell end faces. Such a construction avoids inadvertent manual rotation of the spool, e.g., when a user applies his fingers thereto.

SUMMARY OF THE INVENTION

In view of the foregoing problems, an object of the present invention is to provide a packaging suitable for packaging a leader-advancing photographic film cassette, in which rotation of a spool causes a leader to advance outward from the cassette.

Another object of the present invention is to provide a packaging for packaging a leader-advancing cassette in a state where the cassette spool does not rotate due to shock or vibration.

Still another object of the present invention is to provide a packaging for low cost packaging a leader-advancing cassette.

In order to achieve the above and other objects and advantages of this invention, a packaging for packaging a photographic film cassette has packaging means in which the cassette shell is packaged and stopper means which stops the leader from exiting from the passage mouth while the cassette is contained in the packaging means.

In a preferred embodiment, the stopper means stops the spool from rotating even though the spool has spool ends which do not project from end faces of the cassette shell. The stopper member is fitted to the port portions of the cassette to close the passage mouth.

The packaging in accordance with the present invention, therefore, is advantageous because it can be manufactured at a low cost and the cassette can be easily removed therefrom. The inventive packaging is also advantageous for use with a leader-advancing cassette wherein ends of a spool do not project from the shell end faces which rotatably support the spool. The leader is prevented from inadvertently exiting from the cassette, even in the event of shock or vibration during mass transportation or transportation by a user. The cassette can thus be loaded reliably in a camera adapted for use only with a leader-advancing cassette that must be loaded without protrusion of the leader. Movement of the spool does not influence to regularity of winding of the photographic film within the cassette shell, so that the leader can be advanced outward from the cassette even after undergoing shock or vibration.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
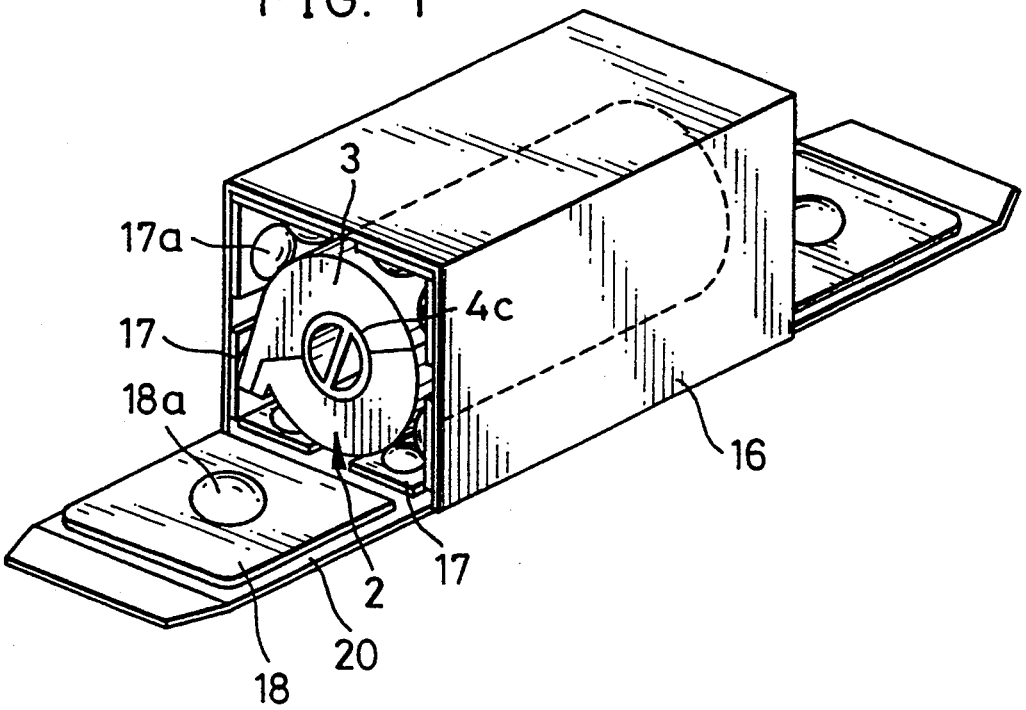
FIG. 1 is a perspective view illustrating a cassette and a packaging therefor in accordance with the present invention.
Figure 2:
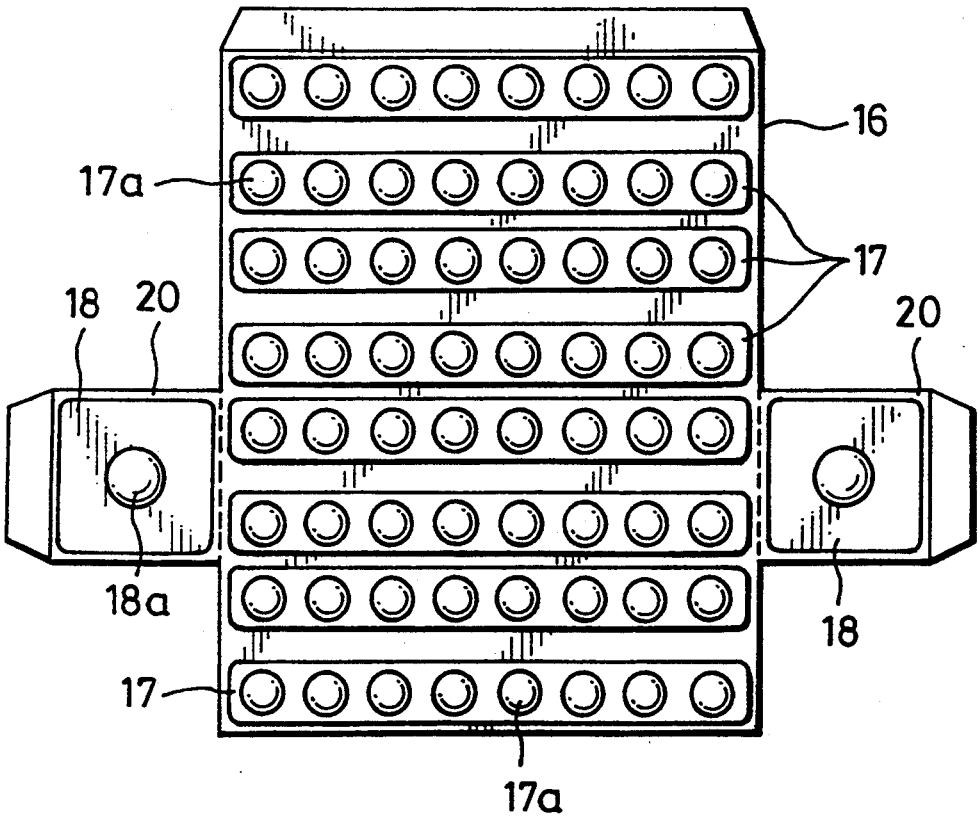
FIG. 2 is a development illustrating the packaging illustrated in FIG. 1.

FIG. 1 illustrates a manner of packaging a photographic film cassette 2. The packaging is mainly constructed from a carton 16, which is formed in the shape illustrated in FIG. 2. Bubbled sheets 17 and 18 are attached to the inside of the carton paper 16. The bubbled sheets 17 and 18 are formed by laminating two sheetings of polyethylene so as to form a series of bubbles or air cells between them. The bubbled sheets 17, shaped in strips, are attached to the inside of the lengthwise extending faces of the carton 16. The bubbled sheets 18 are attached inside the openable flaps 20 of end faces of the carton 16. The carton 16 consists of recycled paper weighing 300 g/m2 as processed with a back lamination of polyethylene at the thickness of 0.2 mm.

Figure 3:
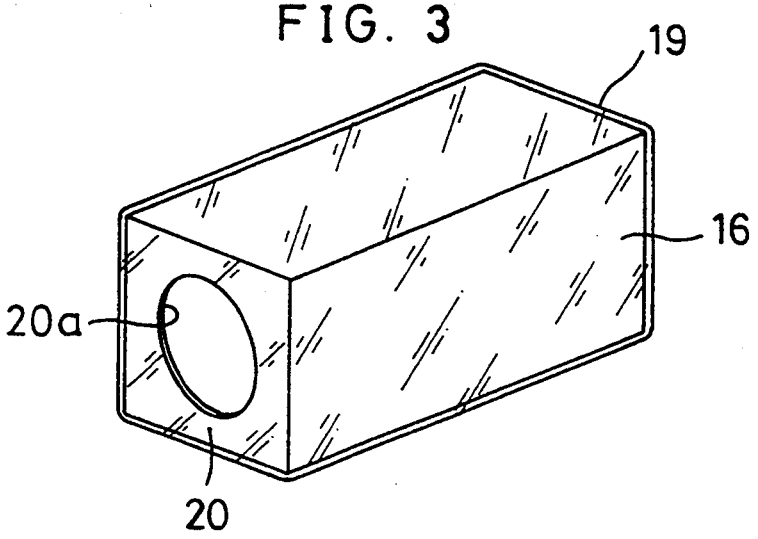
FIG. 3 is a perspective view illustrating a state where the carton is shrink-wrapped.

The bubbled sheets 17 and 18 have air cells 17*a* and 18*a*. The air cells 17*a* of the bubbled sheets 17 have a diameter of 7 mm and are disposed at regular intervals. The air cells 18*a* of the bubbled sheets 18 are 12 mm across, and are projected for contact with a spool end 4*c* as described below. The bubbled sheets 17 and 18 are adhered to the inside of the carton 16 by a laminator. After inserting the cassette 2 in the carton 16, the carton 16 is wrapped in a shrink wrap 19 as illustrated in FIG. 3 to hold the flaps 20 tightly so as to enclose the cassette 2. The presence of the shrink wrap 19 indicates an unused state of the cassette 2, while the absence of the shrink wrap 19 indicates a used state thereof. A hole 20 is formed in the carton 16 so that the user's finger can remove the shrink wrap 19 easily from the carton 16.

Figure 4:
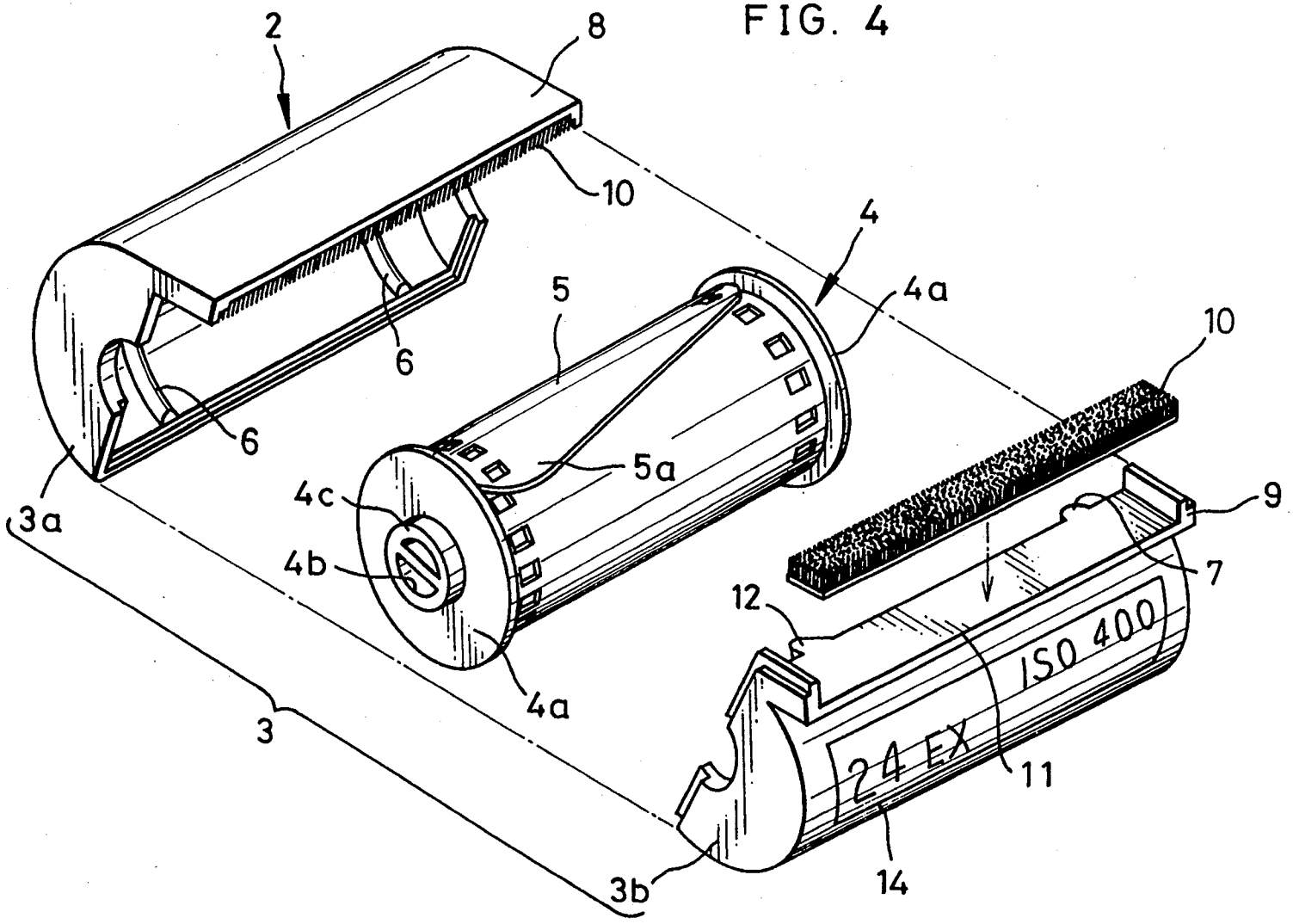
FIG. 4 is an exploded perspective view illustrating the cassette to be packaged in the inventive packaging.

The cassette 2 to be packaged in the packaging according to the present invention is illustrated in FIG. 4. The cassette 2 has a cassette shell 3 constituted of a pair of cassette halves 3*a* and 3*b* molded of resin. A spool 4 is rotatably contained in the cassette shell 3, and has a photographic filmstrip 5 wound thereon. In the state of incorporating the spool 4 in the cassette shell 3, the end 4*c* of the spool 4 is formed to be flush with, or retracted from, the end faces of the cassette shell 3, and thus does not project from the end faces or the outer periphery of the bearing holes in the spool 4. Accordingly, the spool end 4*c* cannot be operated manually e.g. even by applying fingers thereto while the cassette 2 is not loaded in the camera.

An outermost turn of the photographic film 5 is pressed by ridges 6 and 7 formed on the inside of the cassette halves 3*a* and 3*b*. The ridges 6 and 7 prevent the roll of the photographic film 5 from loosening around the spool 4. The cassette halves 3*a* and 3*b* have port portions 8 and 9 between which the photographic film 5 is advanced. When the cassette 2 is loaded in a camera, a fork of the camera is engaged with a pair of recesses 4*b* formed in the spool end 4*c*. When the spool 4 is rotated clockwise, the roll of the photographic film 5 rotates with the spool 4 as the photographic film 5 is tightly wound around the spool 4.

A leader 5*a* of the photographic film 5 rotates until its leading end comes close to the lower port portion 9. The leading end abuts on a separator claw 12 by which the leader 5*a* is separated from the inner roll of the photographic film 5 between spool flanges 4*a*. Further rotation of the spool 4 causes the leader 5*a* to advance through a passage mouth 11, defined by port portions 8 and 9, between pieces 10 of plush or light-trapping fabric 10 adhered to passage mouth 11. Inadvertent rotation of the spool 4 is prevented so that the photographic film 5 will not be advanced out of the cassette 3 to expose it to the ambient light, whether it is unexposed or previously exposed. A reference numeral 14 designates an indication for indicating the ISO sensitivity of the film 5, the number of photographable frames and the like.

Referring to the operation of the present invention, the air cells 17*a* project inside the carton 16 to hold the cassette 2 inward from the inside edges of the carton 16. Therefore the cassette 2 is immovably held in the carton 16. Closure of the flaps 20 within the shrink wrap 19 causes the air cells 18*a* to press both spool ends 4*c* to keep the spool 4 from rotating. Accordingly, while packaged with the invention, the spool 4 will not rotate relative to the cassette shell 3. Also, the leader 5*a* will never exit through the passage mouth 11 even when a shock or vibration takes place during transportation of the packaged cassette. In addition, the turns of the photographic film 5 will not become sloppy with respect to the spool 4 within the cassette shell 3. It is noted that the bubbled sheets 17 and 18 may be replaced by polystyrene foam sheets, or the like, as cushioning mediums, e.g., MYB PACK (trade name) manufactured by Tokan Kogyo Co., Ltd. The flaps 20 of this embodiment are fixed inside the shrink wrap 19, but may be fixed by applying a sticky adhesive agent, a hot-melt adhesive agent, or an adhesive seal.

Figure 5:
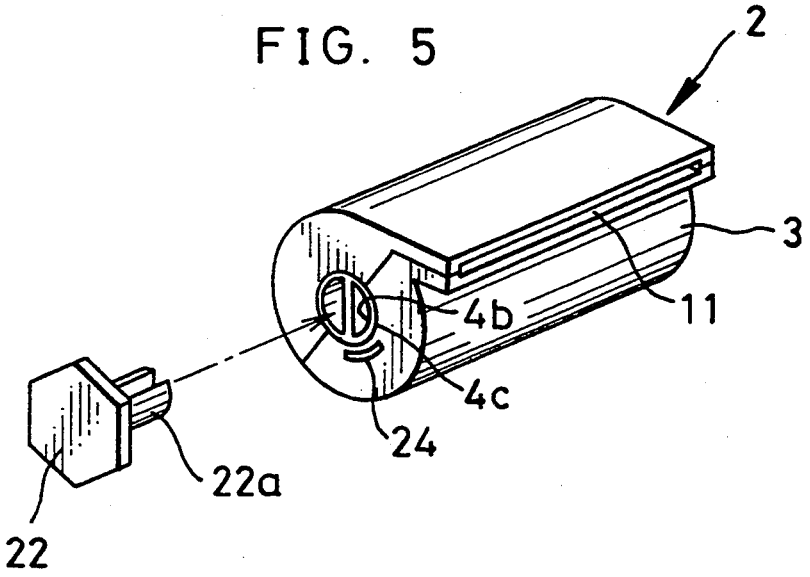
FIG. 5 is a perspective view illustrating a manner of fitting a spool stopper on the spool.
Figure 6:
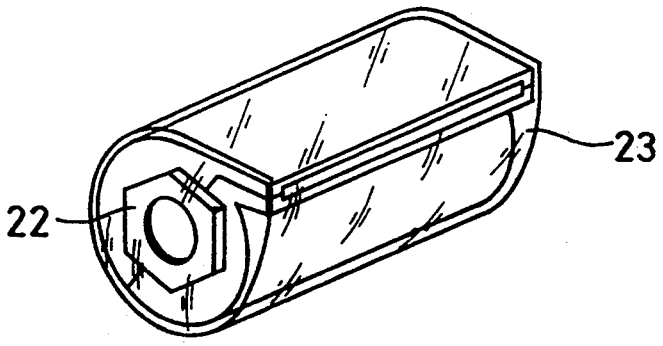
FIG. 6 is a perspective view illustrating a state where the cassette and the spool stopper is shrink-wrapped.

FIGS. 5 and 6 illustrate a packaging including a spool stopper 22 and a shrink wrap 23. The stopper 22 is molded from plastics, and has a fork 22*a* integrally formed thereon. The fork 22*a* is adapted to be fitted in the recesses 4*b* of the spool end 4*c*. When the stopper 22 is coupled with the spool end 4*c* and covered in the shrink wrap 23 together with the cassette 2, the stopper 22 is prevented from rotating with respect to the cassette shell 3. The passage mouth 11 is covered and closed thereby. The state of winding the photographic film 5 is thus maintained and the leader 5*a* is prevented from exiting through the passage mouth 11.

The shrink wrap 23 has a moisture-proof property and thus protects the cassette 2 from moisture. Because the shrink wrap 23 is transparent, the indication 14, on the outside the cassette shell 3, can be seen through the shrink wrap 23 so that any printed indication such as film type is unnecessary on the stopper 22 or the shrink wrap 23. It is preferable that a coverable indication 24, such as letters and a colored mark, is printed to represent a state of the photographic film as exposed in the area covered by the stopper 22 on the outside of the cassette shell 3. Though the photographic film 5 of this cassette 2 is wholly contained in the cassette shell 3 both before and after using the photographic film 5, it is easy to recognize whether or not the photographic film 5 is exposed or unexposed according to whether the indication 24 is uncovered or covered by the stopper 22. From the factory, the cassette 2 may be provided in the state shown in FIG. 6. The packaged cassette may also be collectively overwrapped with other packaged cassettes by use of a laminate pack or a net.

Figure 7:
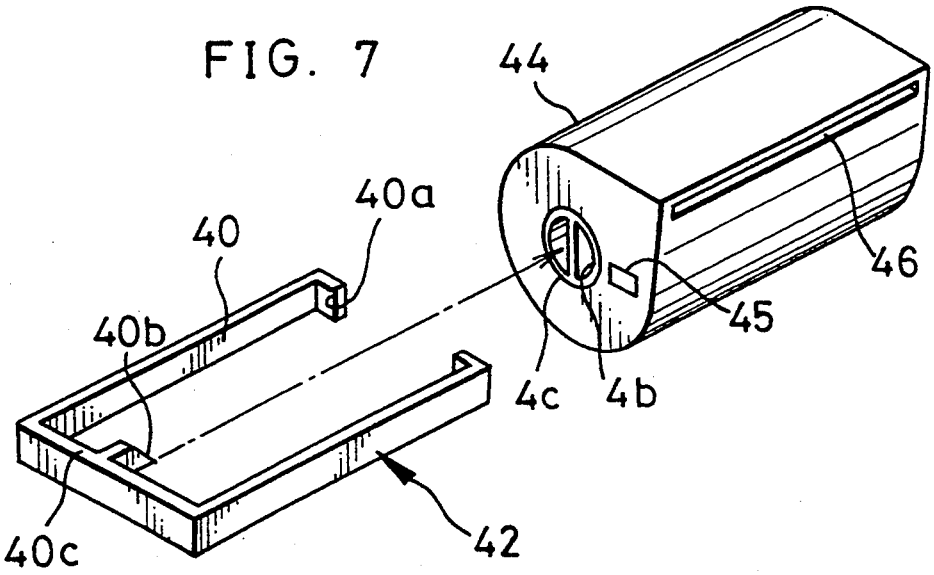
FIGS. 7 and 8 are perspective views illustrating another preferred embodiment of the present invention.
Figure 8:
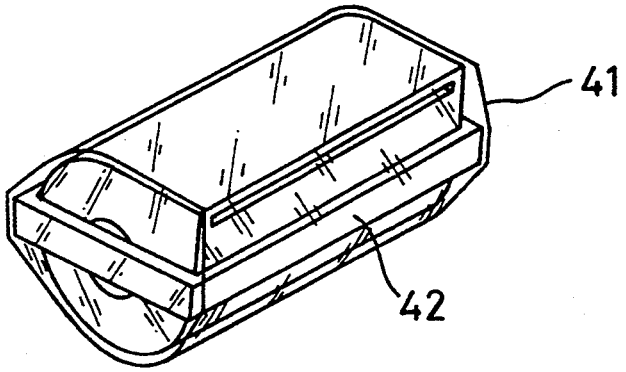

FIGS. 7 and 8 illustrate a packaging according to a second preferred embodiment having a stopper frame 42 and a shrink wrap 41. A cassette 44 has a passage mouth 46 but projecting port portions in order to make it easier to shrink-wrap the cassette 44. The stopper frame 42 is molded from plastics. A pair of arms 40 of the stopper frame 42 have fingers 40*a* to contact an end face of the cassette 44. A claw 40*b* projects from a proximal portion 40*c* to be coupled with one of the recesses 4*b* of the spool end 4*c*. When the stopper frame 42 is mounted on the cassette 44 by spreading the arms 40, the claw 40*b* having a tapered tip is received in the one recess 4*b* in engagement therewith so that the stopper frame 42 prevents the spool 4 from rotating (see FIG. 8).

Figure 9:
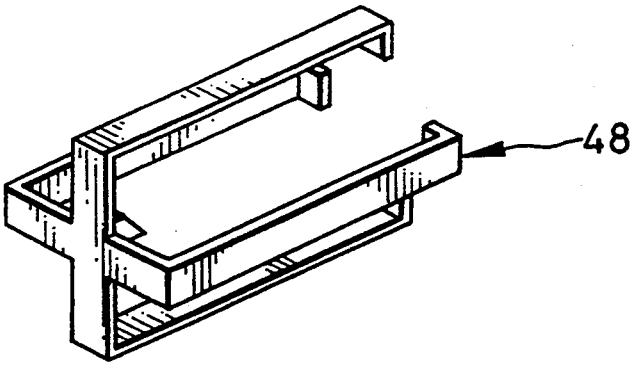
FIG. 9 is a perspective view illustrating a variant form of the stopper frame.

An indication 45 formed outside the cassette 44 for indicating an exposed state of the photographic film 5 is covered by the stopper frame 42. The cassette 44, with the stopper frame 42 mounted thereon, is wrapped in the shrink wrap 41 to hold the stopper frame 42 tightly to the cassette 44. The shrink wrap 41 also closes the passage mouth 46. Accordingly, the roll of the photographic film 5 is prevented from loosening even when subjected to shock or vibration, whereas the leader can also be prevented from protruding. The second embodiment having the stopper frame 42 and the shrink wrap 41 is also applicable to the above-mentioned cassette 2. Instead of the stopper frame 42, a crosswise stopper frame 48 as illustrated in FIG. 9 may be utilized which is constructed in a manner similar to the frame 42 but with four arms.

Figure 10:
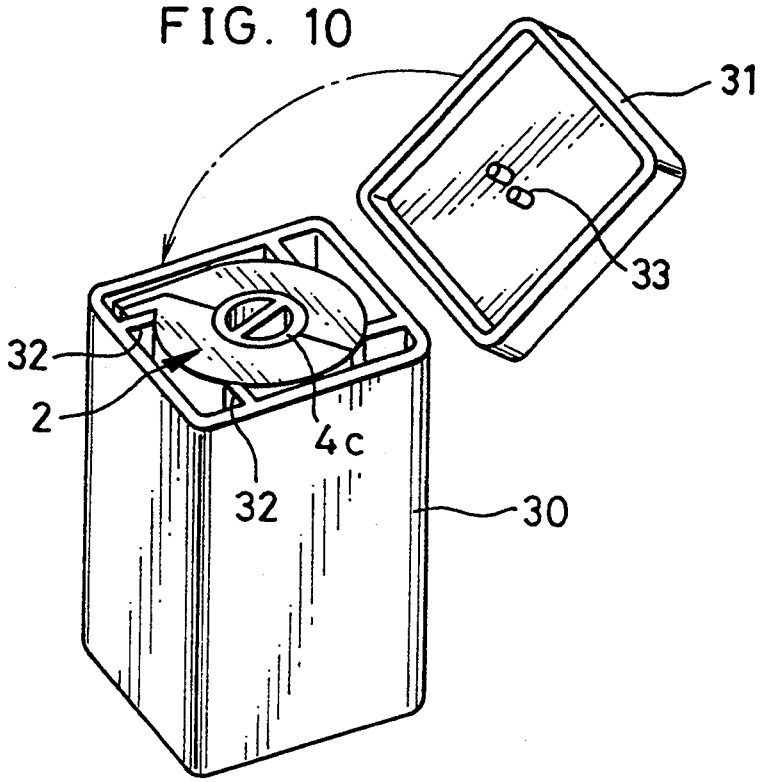
FIGS. 10 and 11 are perspective views illustrating still other preferred embodiments of the present invention.

FIG. 10 illustrates a packaging according to a third embodiment having a box 30 and a cap 31 for closing the box 30 in a moisture-proof state. Both the box 30 and the cap 31 are molded from polypropylene. Inside the box 30 are formed ridges 32 for contact with the outside of the cassette 2 to position the cassette 2 in the box 30. One of the ridges 32 is adapted to be in contact with the lower port portion 9. Projections 33 are formed on the inside of cap 31 to be received in the recesses 4*b* of the spool end 4*c*. The cassette 2 is prevented from moving or rotating in the box 30 by ridges 32. The spool 4 is prevented from rotating by the projections 33. The disposition of the ridges 32 is determined to be rotationally symmetrical, so that the passage mouth 11 of the cassette 2 can be positioned in any inside edge within the box 30. The cap 31 is joined to the box 30 by a tight pressure fitting. There may be engaging portions, i.e. projections and recessed portions, on the edges of the box 30 and the cap 31 which are engaged when the cap 31 is attached to the box 30.

Figure 11:
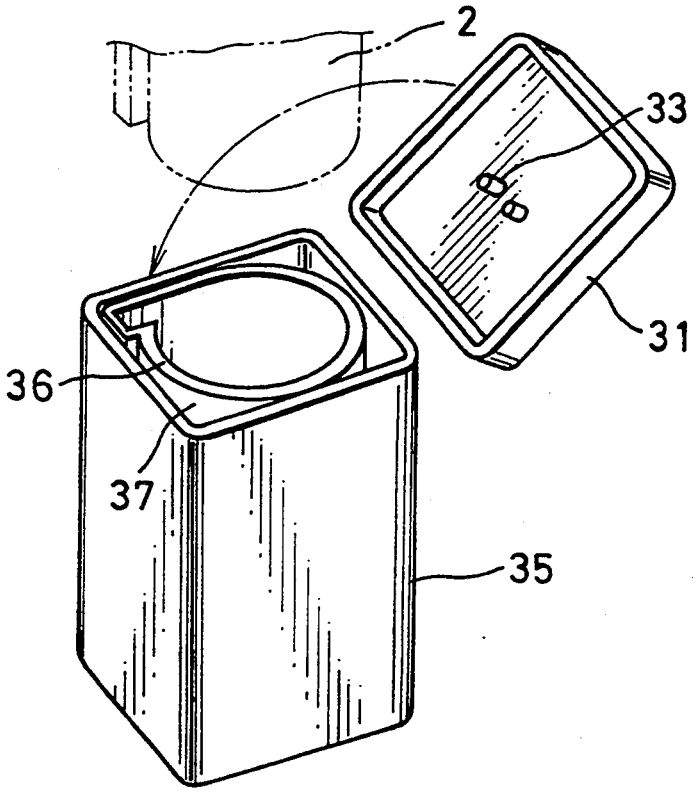

A box 35 in FIG. 11, according to a fourth embodiment, for packaging the cassette 2 is twofold constructed. An inner case 36 of the box 35 has an inside surface contoured to receive the cassette 2 fitted snugly therein, so as to position the cassette 2 in the box 35. The cap 31 is fitted on the box 35 to enclose it. A space 37 outside the inner wall 36 may be used for containing a dehumidifier agent or a desiccating agent.

Figure 12:
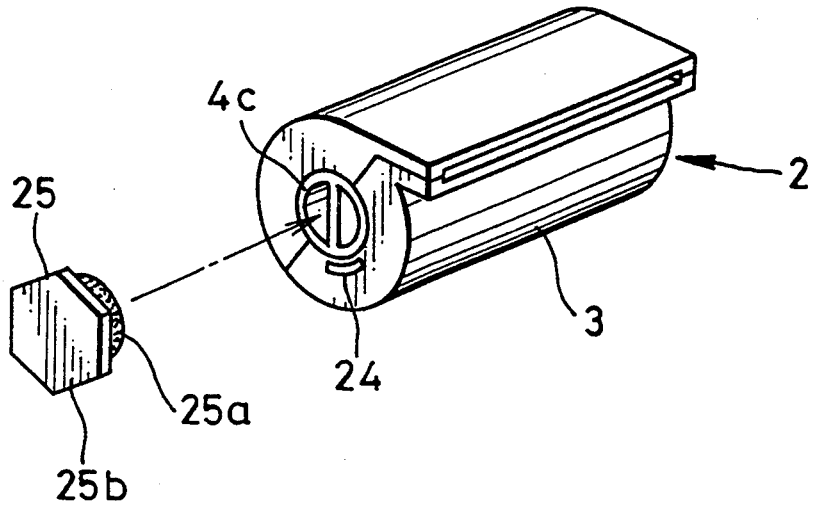
FIG. 12 is a perspective view illustrating a manner of fitting a variant spool stopper on the spool.
Figure 13:
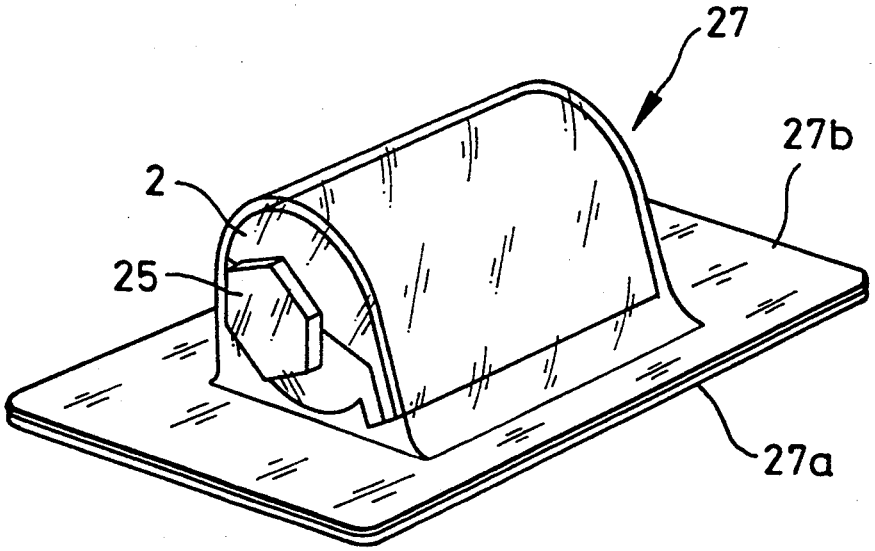
FIG. 13 is a perspective view illustrating a state where the cassette with the spool stopper is packaged in a blister pack.

In FIGS. 12 and 13, illustrating a fifth embodiment, a spool stopper 25 is constituted of a flat plate 25*b* and an elastic spongy piece 25*a* attached thereto. Although the stopper 22 of FIG. 5 stops the spool 4 by being engaged therewith, the spongy piece 25*a* of the stopper 25 of this embodiment is pressed against the spool end 4*c* to stop the spool 4 from rotating. The spongy piece 25*a* consist of a spongy material such as polystyrene foam, urethane foam and rubber, or the like. The cassette 2 with the stopper 25 is packaged in a blister pack 27 as illustrated in FIG. 13, which holds the stopper 25 tightly on to the cassette shell 3. The blister pack 27 is constituted of a paper sheet 27*a* and a resinous sheet 27*b* covered thereon to form a blister. The paper sheet 27*a* weighs 300 g/m2 as processed with a one-sided lamination of aluminum foil at a thickness of 7 mm. The resinous sheet 27*b* is formed from high impact polystyrene at a thickness of 0.3 mm. A number of such blister packs can be continuously formed from long sheets, which sheets are provided with linearly arranged perforations along which the sheets are easily torn.

Figure 14:
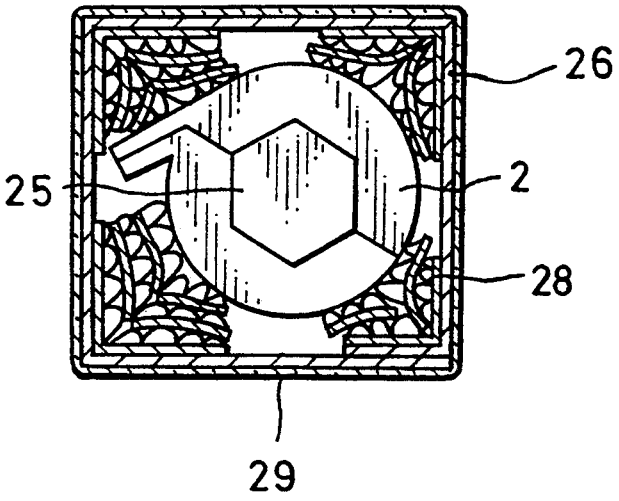
FIG. 14 is a cross section illustrating another state where the cassette with the spool stopper is packaged.

The packaging illustrated in FIG. 14, according to a sixth embodiment, lacks the blister pack 27 but has a carton 26 similar to the carton 16 of FIG. 1. Instead of the bubbled sheets 17, pieces of corrugated boards 28 are attached inside the carton 16. The openable flaps 20 are closed to hold the stopper 25. To fix the flaps 20 in closure, the shrink wrap 29 similar to shrink wrap 19 in FIG. 3, or adhesive agent or other suitable means are utilized.

Figure 15:
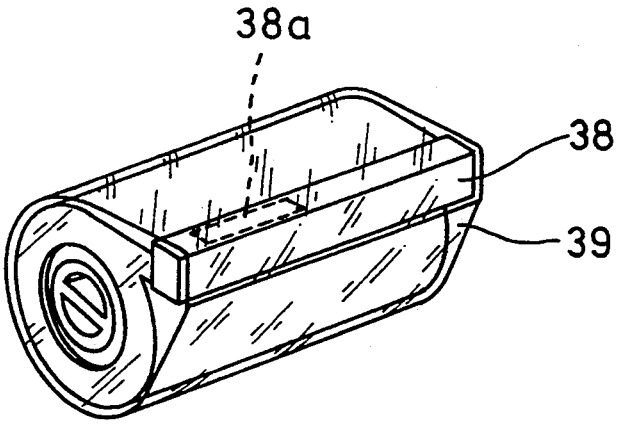
FIG. 15 is a perspective view illustrating an embodiment in which a passage mouth is closed by a port stopper.

FIG. 15 illustrates a seventh preferred embodiment in which the passage mouth 11 of the cassette 2 is closed. A port stopper or cover 38 covers the passage mouth 11. The cassette 2 with the port stopper 38 attached thereto is wrapped in a shrink wrap 39. The outside of the port portion 8 or 9 to be covered by the port stopper 38 may preferably have and an indication 38*a* representing a state of the photographic film as exposed, which is covered by the port stopper 38. It is noted that, to close the passage mouth 11, only the shrink wrap 39 may cover the passage mouth 11 in omission of the port stopper 38. This manner of closure is depicted in FIGS. 6 and 8 as the shrink wrap 23 or 41.

Experiments were conducted comparing the inventive packaging disclosed herein and conventional packaging. Cassettes were packaged in the various packagings and subjected to random vibration at 30 to 100 Hz caused by a vibration testing machine for 24 hours. Spools of the cassettes were then rotated to test the capacity for advancing the leader. As a result, the leader of all the sample cassettes from any of the embodiments of the invention was advanced outward without fail by application of a comparatively small torque. The leader of about 30% of the sample cassettes from the P case (a conventional packaging), however, failed to advance even when rotating the spools.

Of the inventive packagings, those illustrated in FIGS. 1 and 14 are advantageous because they can be easily manufactured at a low cost. The packagings illustrated in FIGS. 8, 12 and 13 are advantageous in their capability of preventing the roll from being sloppy with respect to the spool, and in facilitating unpackaging. The packaging illustrated in FIG. 15 is advantageous because of its high level of protection of the port portions between which the leader is advanced, and thus its prevention of performance reduction of the cassette in advancing the leader as well as shielding light. There is an additional advantage in which, when the spool stopper 22, 25, 42, 48 or the port stopper 38 is separate from the packaging means e.g. shrink wrap, the exposed or unexposed state of the photographic film can be easily discerned by exposure of a coverable indication as formed on the portion of the cassette to be covered by this separate member.

It is noted that the cassette to be packaged in the inventive packaging has a spool of which only one spool end is exposed to the outside and the other spool end is supported inside the end face of the cassette. However, the present invention is also applicable to packaging a metal cassette shell, or a cassette of which an end of a spool is projected over a shell end face of a bearing hole.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention as defined by the appended claims, they should be construed as included therein.

What is claimed is:

1. A packing unit comprising:

a photographic film cassette comprising a spool with photographic film wound thereon and a cassette shell for rotatably containing said spool, rotation of said spool causes a leader of said photographic film to advance outward through a passage mouth defined between port portions formed in said cassette shell;

packaging means for packaging said photographic film cassette, said packaging means being disposed around said photographic film cassette, said packaging means includes a carton having an openable flap;

stopper means being provided inside said packaging means for preventing said leader from exiting from said passage mouth while said cassette is contained in said packaging means, said stopper means including a bubbled sheet attached to an inside of said openable flap and provided with an air cell which presses on one end of said spool to prevent rotation of said spool relative to said cassette shell.

2. A packaging unit as defined in claim 1, wherein second bubbled sheets are mounted on an inside of said carton, said second bubbled sheets having air cells which protrude so as to hold said cassette shell.

3. A packaging unit as defined in claim 2, wherein said packaging means further includes a shrink wrap for wrapping said carton.

* * * * *